US007682173B2

(12) United States Patent
Zhu et al.

(10) Patent No.: US 7,682,173 B2
(45) Date of Patent: Mar. 23, 2010

(54) ELECTRICAL CONNECTOR WITH IMPROVED CONTACTS

(75) Inventors: Zi-Qiang Zhu, Kunshan (CN); Zhang-Lan Xue, Kunshan (CN); Hong-Qiang Han, Kunshan (CN); Lun-Song Hu, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 42 days.

(21) Appl. No.: 12/218,738

(22) Filed: Jul. 16, 2008

(65) Prior Publication Data

US 2009/0023340 A1 Jan. 22, 2009

(30) Foreign Application Priority Data

Jul. 16, 2007 (CN) ..... 2007 2 0040752 U

(51) Int. Cl.
*H01R 29/00* (2006.01)

(52) U.S. Cl. ..... 439/188; 439/620.17

(58) Field of Classification Search ..... 439/620.17–620.23, 676, 188
See application file for complete search history.

(56) References Cited

U.S. PATENT DOCUMENTS 4,633,048 A * 12/1986 Komatsu ..... 200/51.12
4,937,404 A 6/1990 Kitagawa
6,659,784 B1 * 12/2003 Klein et al. ..... 439/188
7,134,890 B2 * 11/2006 Wang ..... 439/188
7,137,851 B2 11/2006 Xue et al.
2006/0128194 A1 * 6/2006 Wang et al. ..... 439/188

* cited by examiner

*Primary Examiner*—Briggitte R Hammond
(74) *Attorney, Agent, or Firm*—Wei Te Chung; Andrew C. Cheng; Ming Chieh Chang

(57) ABSTRACT

An electrical connector (100) includes an insulative housing (1) having a receiving cavity (12) for receiving a mating plug and a plurality of passageways (161, 162, 163, 164, 165); and a plurality of contacts (2) retained in the passageways respectively. The contacts define a first contact (22) which is stationary and having a first contacting portion (224), a first soldering portion (225) and a first base portion (221) connecting with the first contacting portion and the first soldering portion; and a second contact (23) which is movable to mate with the first contact to form a switch and having a second base portion (230) and a second soldering portion (235) extending downwardly from the second base portion, a second contacting portion (232) extending upwardly from the second base portion. The first contacting portion extends in a first direction. The second contacting portion extends in a second direction which is not parallel to the first direction.

16 Claims, 7 Drawing Sheets

ELECTRICAL CONNECTOR WITH IMPROVED CONTACTS

BACKGROUND OF THE INVENTION

1. Field of the Invention

The present invention generally relates to an electrical connector and more particularly to an electrical connector having improved contacts.

2. Description of Related Art

A conventional audio jack is usually used in electrical equipments such as stereo audio equipment, mobile phones and the like for contacting with a mating plug. The audio jack is mounted on a printed circuit board, and comprises an insulative housing defining a front mating face and a receiving cavity extending through the insulative housing, and a plurality of contacts retained in the receiving cavity. The contacts include at least a switch comprising a stationary contact and a movable contact located adjacent to the stationary contact. The movable contact has a flexible arm which can be deflected by the plug to engage with or disengage from a contacting arm of the stationary contact. However, the contacting arm overlap the flexible arm too much along a lateral direction of the insulative housing, such that the effect of anti-cross-talk between the stationary contact and the movable contact is adversely affected, in other words, the quality of signal transmitted in the audio jack is not desirable as expected.

It is thus desired to provide an electrical connector having an improved soldering portion.

SUMMARY OF THE INVENTION

According one aspect of the present invention, an electrical connector to be mounted on a printed circuit board, including: an insulative housing having a receiving cavity for receiving a mating plug and a plurality of passageways and a plurality of contacts retained in the passageways respectively. The contacts include a first contact which is stationary and having a first contacting portion, a first soldering portion and a first base portion connecting with the first contacting portion and the first soldering portion; a second contact which is movable to mate with the first contact to form a switch and having a second base portion and a second soldering portion extending downwardly from the second base portion, a second contacting portion extending upwardly from the second base portion; wherein the first contacting portion extends in a first direction, the second contacting portion extends in a second direction which is not parallel to the first direction.

According to another aspect of the present invention, an electrical connector to be mounted on a printed circuit board, including an insulative housing having a receiving cavity for receiving a mating plug and a plurality of passageways; and a plurality of contacts retained in the passageways respectively. The contacts includes a first contact which is stationary and having a first contacting portion, a first soldering portion to be fixed on a printed circuit board and a first base portion retained in the insulative housing; a second contact which is movable to mate with the first contact to form a switch and having a second base portion and a second soldering portion extending downwardly from the second base portion, a second contacting portion defining a contacting area to contact with the first contacting portion; wherein the first contact and the second contact does not overlap each other except for the contacting area along a direction of the movement of the second contacting portion.

Other objects, advantages and novel features of the present invention will become more apparent from the following detailed description of the present embodiment when taken in conjunction with the accompanying drawings.

DETAILED DESCRIPTION OF THE INVENTION

Figure 1:
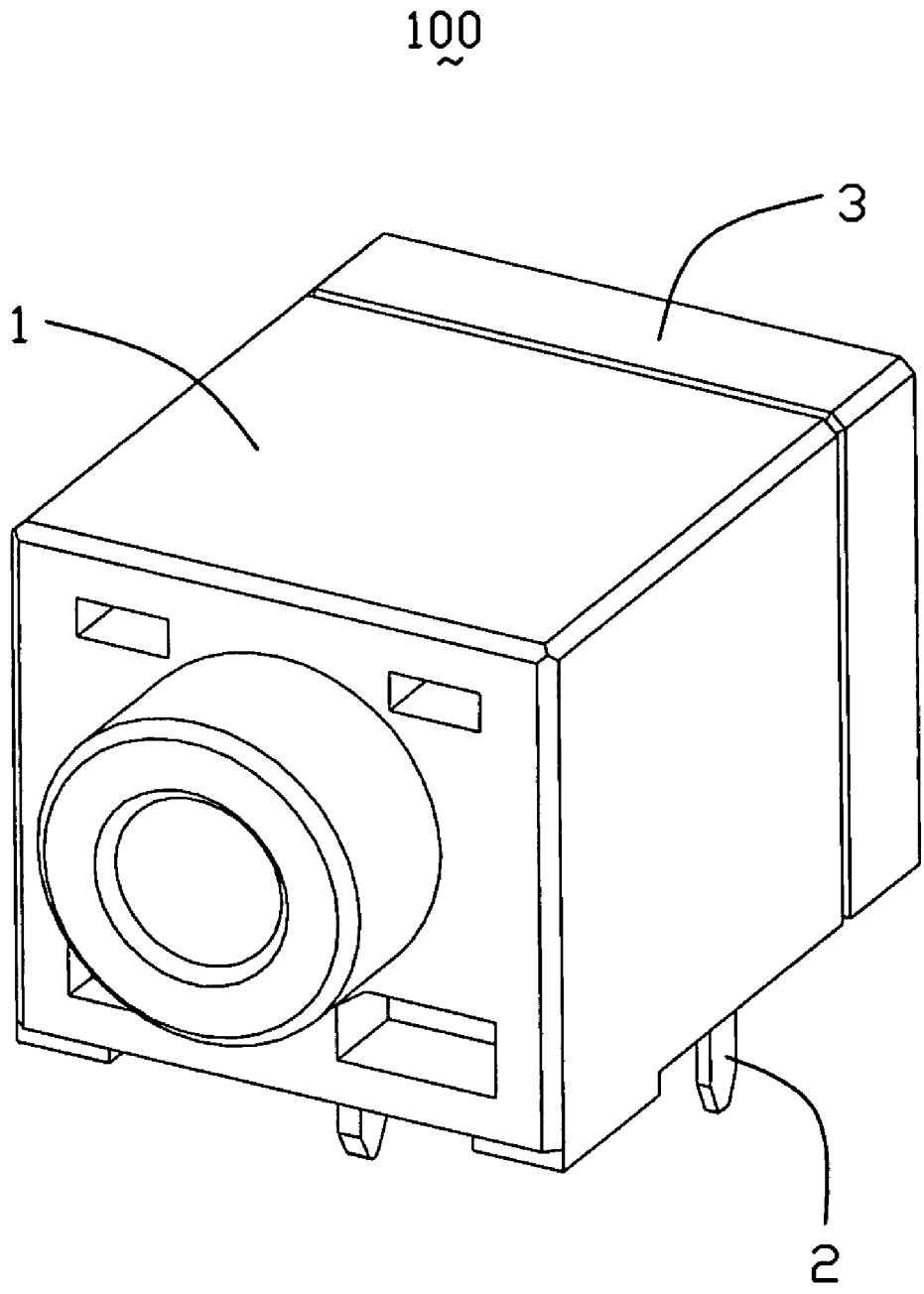
FIG. 1 is an assembled perspective view of an electrical connector according to the present invention.

Reference will now be made to the drawing figures to describe the preferred embodiment of the present invention in detail.

Figure 2:
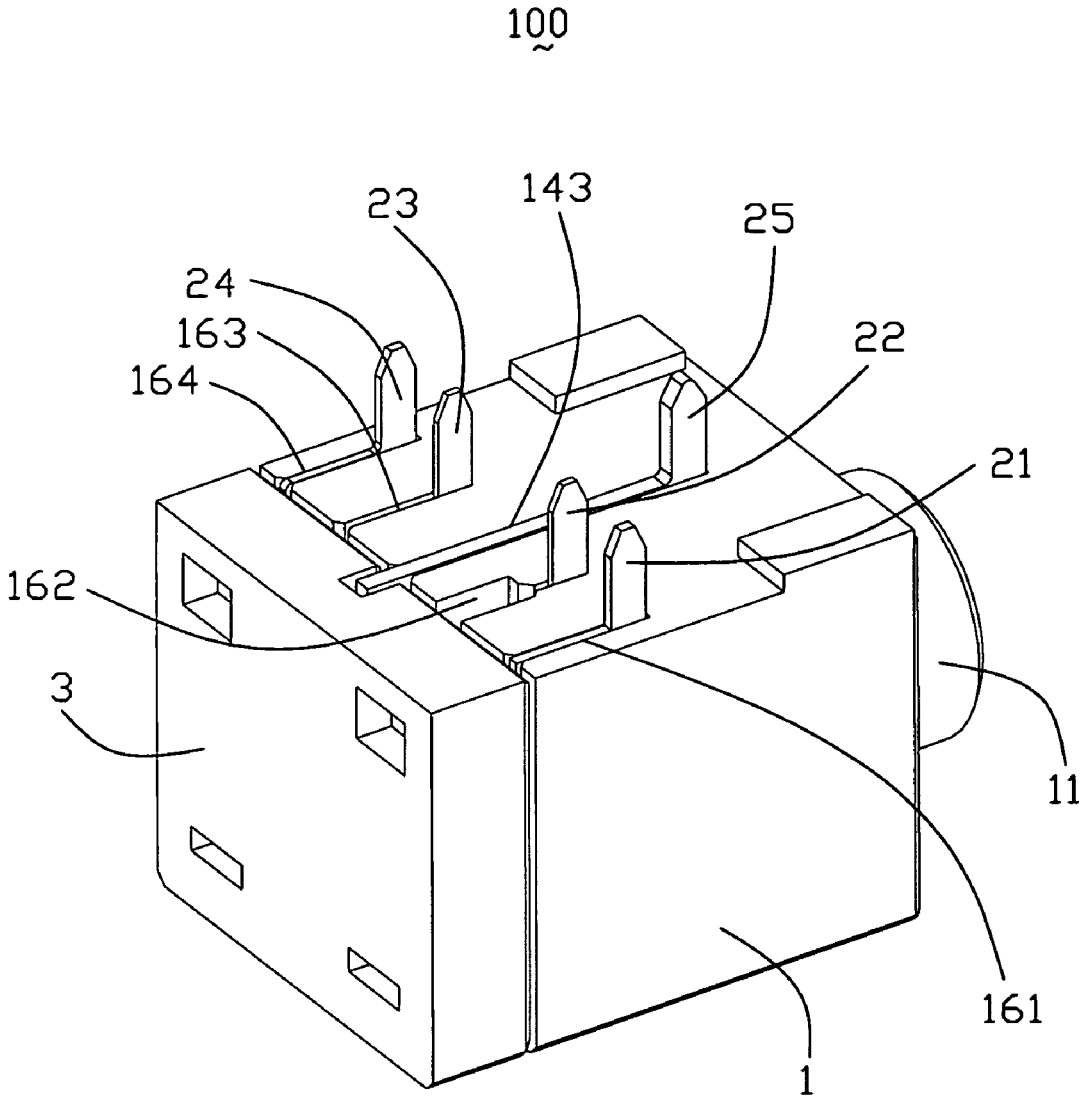
FIG. 2 is a bottom view of the electrical connector.
Figure 3:
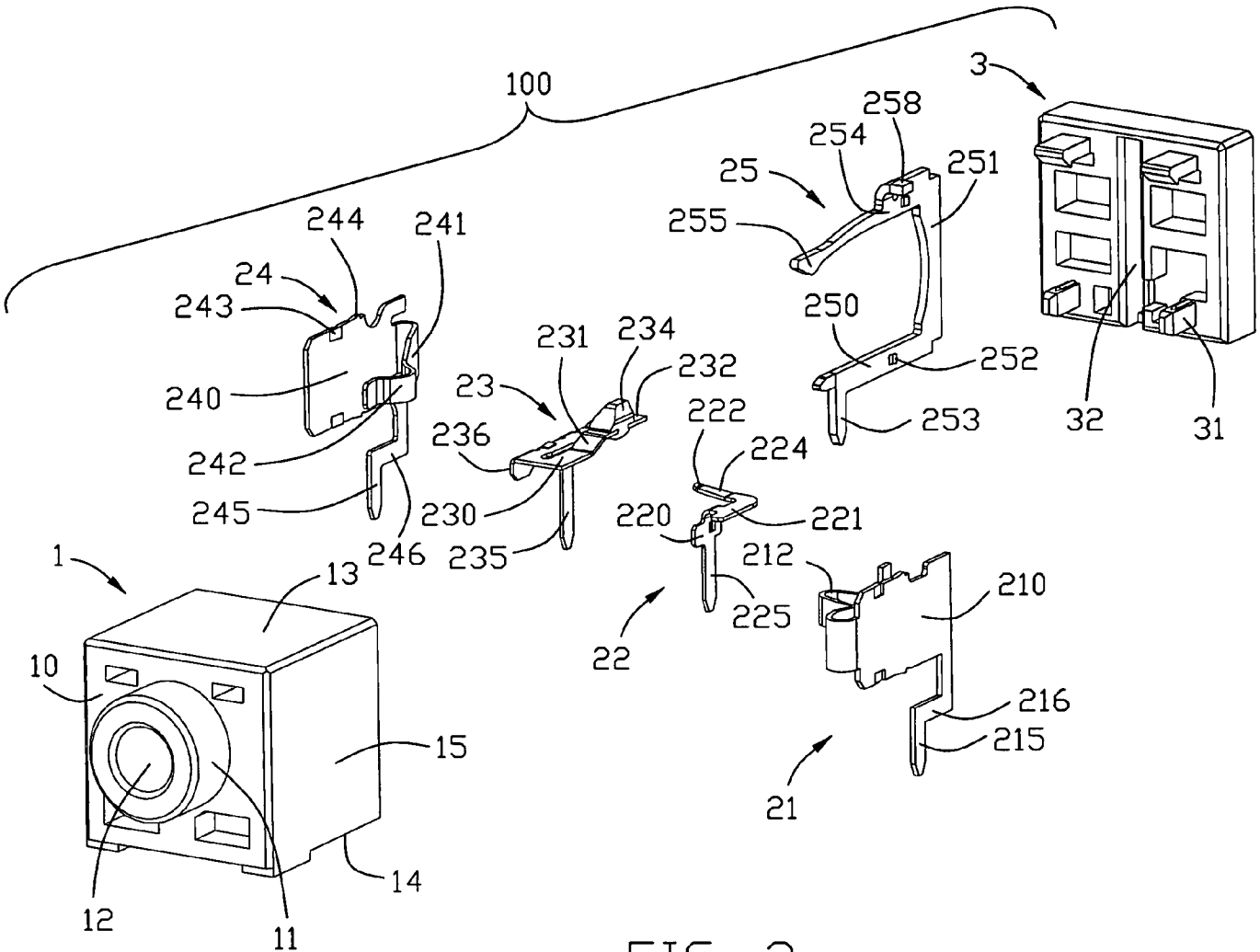
FIG. 3 is an exploded perspective view of the electrical connector shown in FIG. 1.
Figure 4:
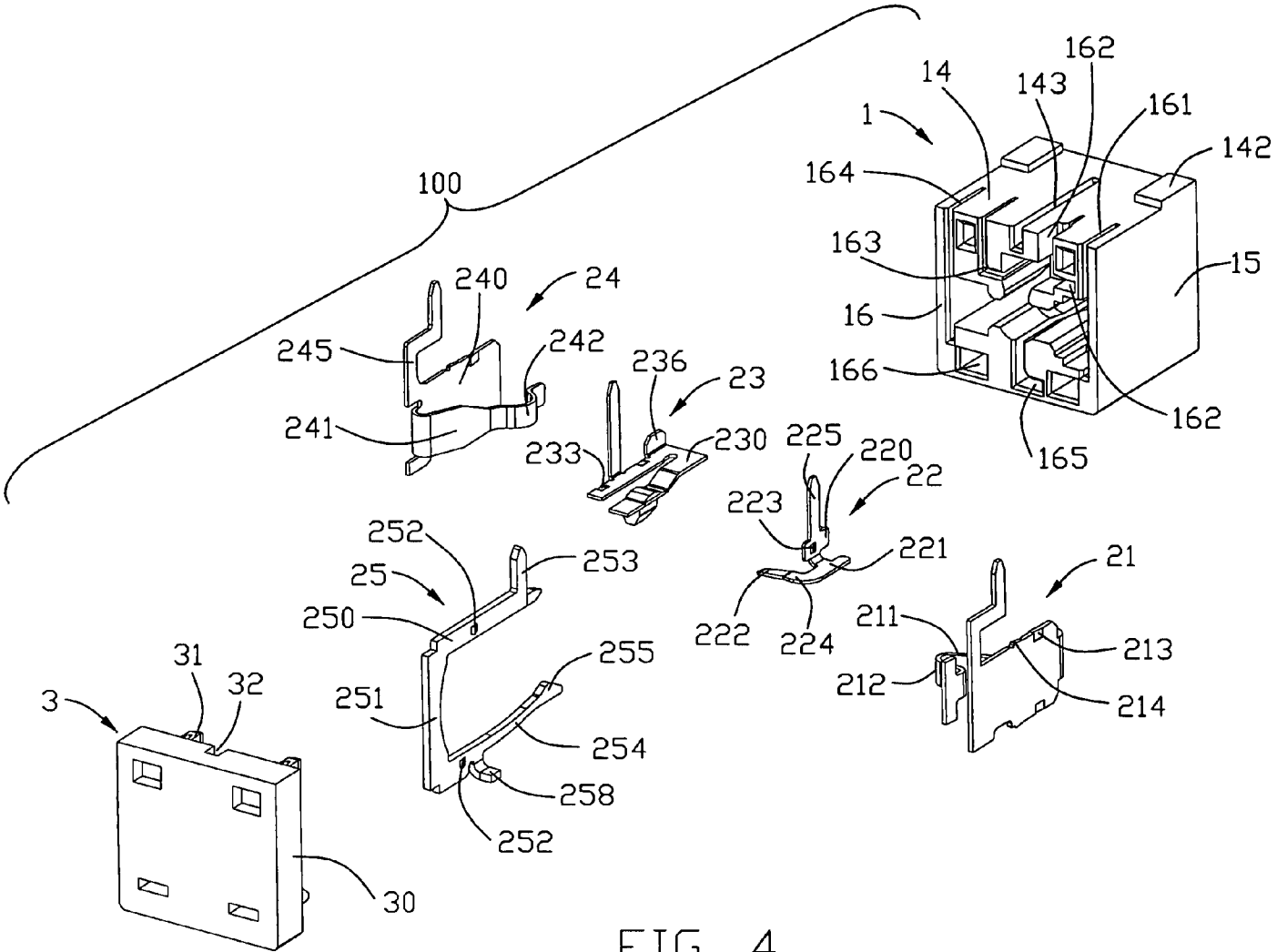
FIG. 4 is a view similar to FIG. 3, while taken from a different aspect.
Figure 5:
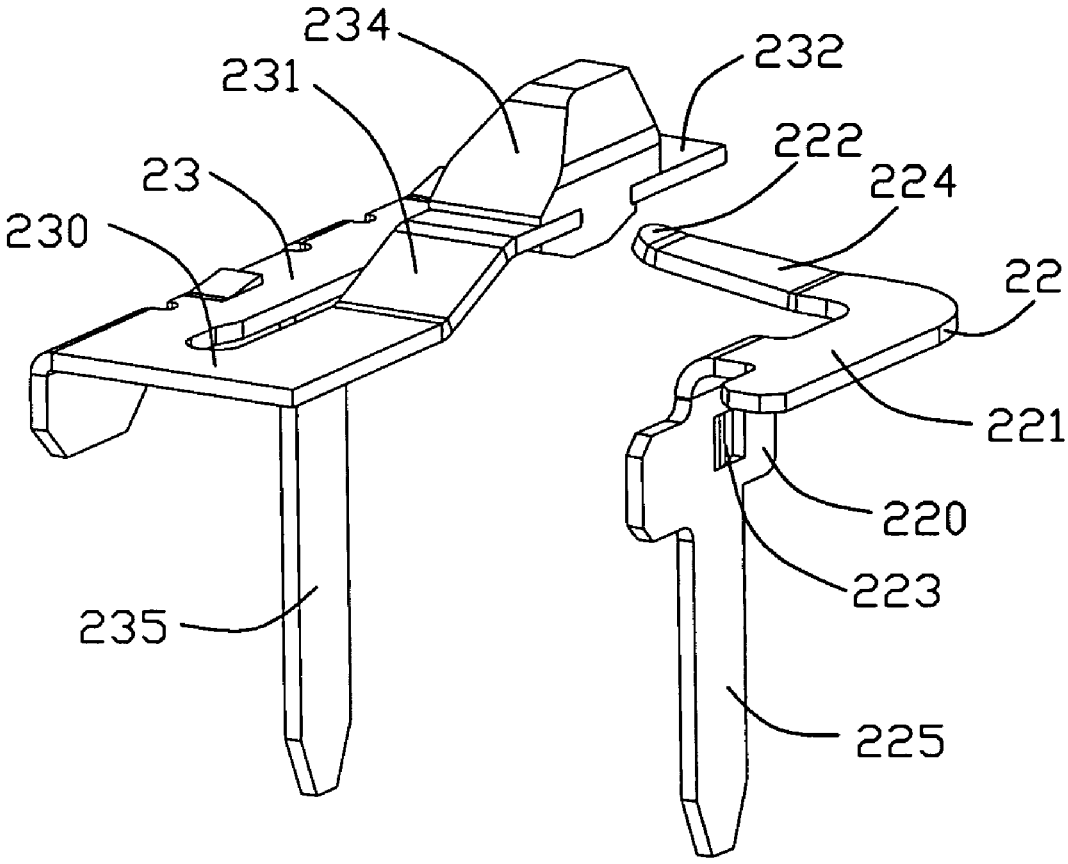
FIG. 5 is a view of a switch of the electrical connector.

Referring to FIGS. 1 and 2, an electrical connector 100, preferably an audio jack connector, comprises an insulative housing 1, a plurality of electrical contacts 2 and a cover 3 retained on a rear side of the housing 1.

The housing 1 has a rectangular body portion 10, a front column portion 11 extending from the body portion 10 and a receiving cavity 12 extending rearwardly through the front column portion 11 for receiving a mating plug (not shown). The body portion 10 has a plurality of side walls 13, 14, 15. The cover 3 has a base plate 30 and four position tabs 31 extending forwardly therefrom to lock with the rectangular body portion 10. A plurality of position holes 186 are provided on a rear side of the body portion 10 to accommodate the position tabs 31.

The contacts 2 includes a first contact 22, a second contact 23, a third contact 24, a fourth contact 21, and a fifth contact 25. The third contact 24 and the fourth contact 21 each comprises a vertical base portion 240, 210, a connection portion 246, 216 extending downwardly and then forwardly from the base portion 240, 210, a third soldering portion 245 and a fourth soldering portion 215 extending perpendicularly and downwardly from the connection portion 246, 216 respectively, and a spring arm 241, 211 bent inwardly from one end of the base portion 240, 210. A contacting portion 242, 212 is provided on the spring arm 241, 211 to contact with the mating plug.

The first contact 22 and the second contact 23 constitute a switch to detect an insertion of the mating plug, and each includes a base portion 220, 230, a first soldering portion 225 and a second soldering portion 235 projecting perpendicularly and downwardly from the base portion 220, 230. A spring arm 231 extends upwardly from a front end of the base portion 230. A contacting portion 232 is formed on the spring arm 231 to contact with the first contact 22 upon insertion of the mating plug. A plastic block 234 is attached to a free end of the spring arm 231 and is located above the contacting portion 222.

The first contacting portion 224 extends along a lateral direction of the housing 1 and defines a contacting area 222 to contact with the second contacting portion 232, the second contacting portion 232 extends along a lengthwise direction of the housing 1. The first contact 22 and the second contact 23 does not overlap with each except for the contacting area 222 in a height direction of the housing 1, thereby achieving a more desirable anti-cross talk effect. The first contact 22 and the second contact 23 does not overlap with each except for the first soldering portion 225 and the second soldering portion 235 in a lateral direction of the housing 1. The soldering portions 215, 225, 235, 245 are positioned along a predetermined line in the lateral direction of the housing 1, the fifth soldering portion 255 is located before the line. The third soldering portion 245 and the fourth soldering portion 215 each is shorter than the first soldering portion 225 and the second soldering portion 235, such that an overlapping area between the soldering portion 245, 215 and the soldering portion 225, 235 is decreased.

The fifth contact 25 is substantially U-shaped, comprises a fifth base portion 250, a fifth soldering portion 253 projecting perpendicularly and downwardly from one end of the fifth base portion 250, a transition arm 251 extending upwardly from the other end of the fifth base portion 250, a spring arm 254 extending forwardly from an upper end of the transition arm 251. A contacting portion 255 is formed on a distal end of the spring arm 254 to contact with the mating plug. The base plate 30 of the cover 3 defines a central slot 32 for receiving the transition arm 251. A retention arm 258 protrudes laterally from a substantially middle portion of the spring arm 254.

The housing 1 includes a first passageway 162, a second passageway 163, a third passageway 164, a fourth passageway 161, a fifth passageway 165 adapted to retain the first contact 22, the second contact 23, the third contact 24, the fourth contact 21, and the fifth contact 25 respectively, a plurality of barbs 223, 233, 243, 213, 252 are provided on the base portions 220, 230, 240, 210, 250 to interferentially engage with the first passageway 162, the second passageway 163, the third passageway 164, the fourth passageway 161, the fifth passageway 165 respectively. The second base portion 230 defines a barb 233 retained in insulative housing 1 along a height direction of the insulative housing 1 and a retaining plate 236 extending downwardly from a side edge of the second base portion 230 to be fixed in insulative housing 1 along a lateral direction of the insulative housing 1.

In assembly, the first contact 22, the second contact 23, the third contact 24, the fourth contact 21, and the fifth contact 25 are inserted into the first passageway 162, the second passageway 163, the third passageway 164, the fourth passageway 161, the fifth passageway 125 from a rear side of the housing 1 in a rear-to-front direction respectively. The fourth contact 21 and the third contact 24 are substantially disposed on a left and a right side of the receiving cavity 16. The first contact 22 and the second contact 23 are located on a lower side of the receiving cavity 16. The contacting portions 212, 242, 255 and the plastic block 234 project into the receiving cavity 16 to connect with the mating plug.

Figure 6:
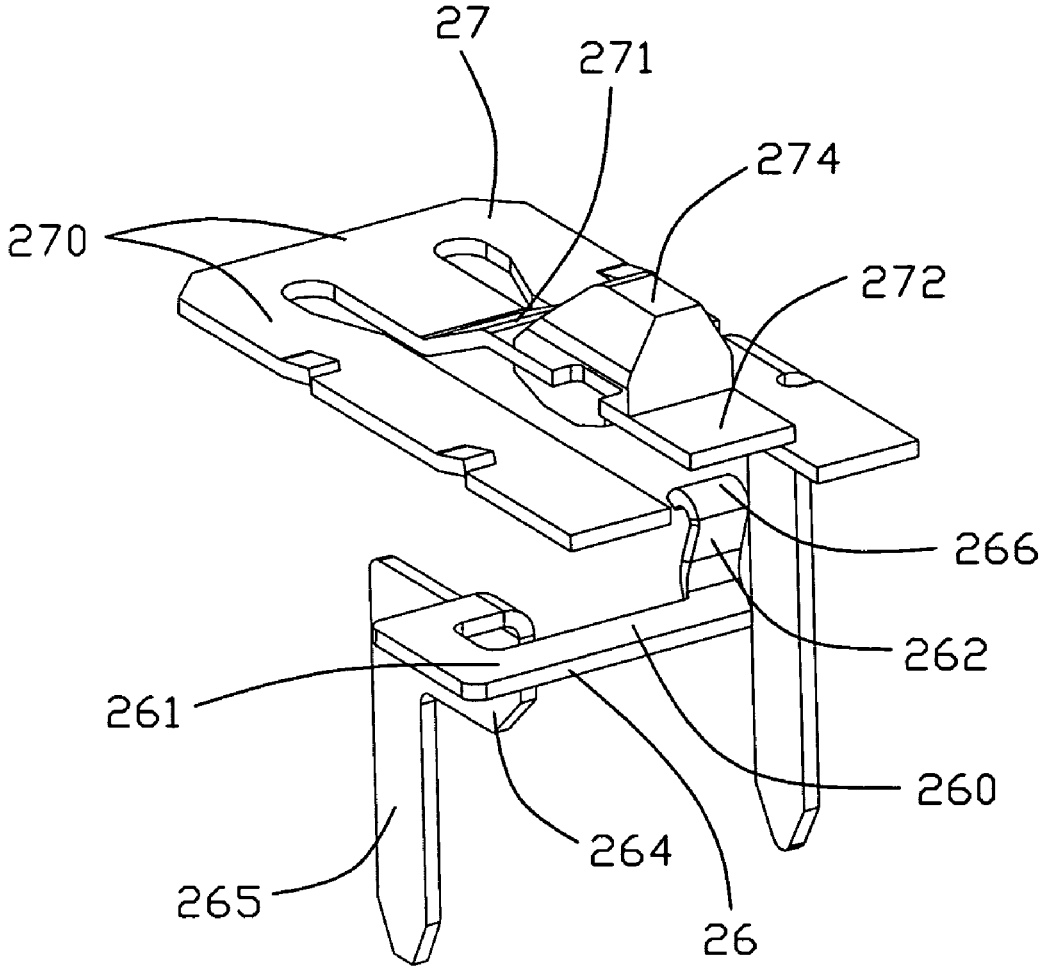
FIG. 6 is a view of the switch in an alternative embodiment of the electrical connector.

As shown in FIG. 6, a second embodiment of the electrical connector 100 is similar to the first embodiment shown in FIGS. 1-5, and differs in that a first contact 26 has a first contacting arm 260 extending upwardly from the first base portion 261, the first contacting arm 260 is provided with a first contacting portion 266 which is semi-circularily curved, the second base portion 270 is U-shaped, the second contacting arm 271 extends forwardly from a substantially of the second base portion 270.

Figure 7:
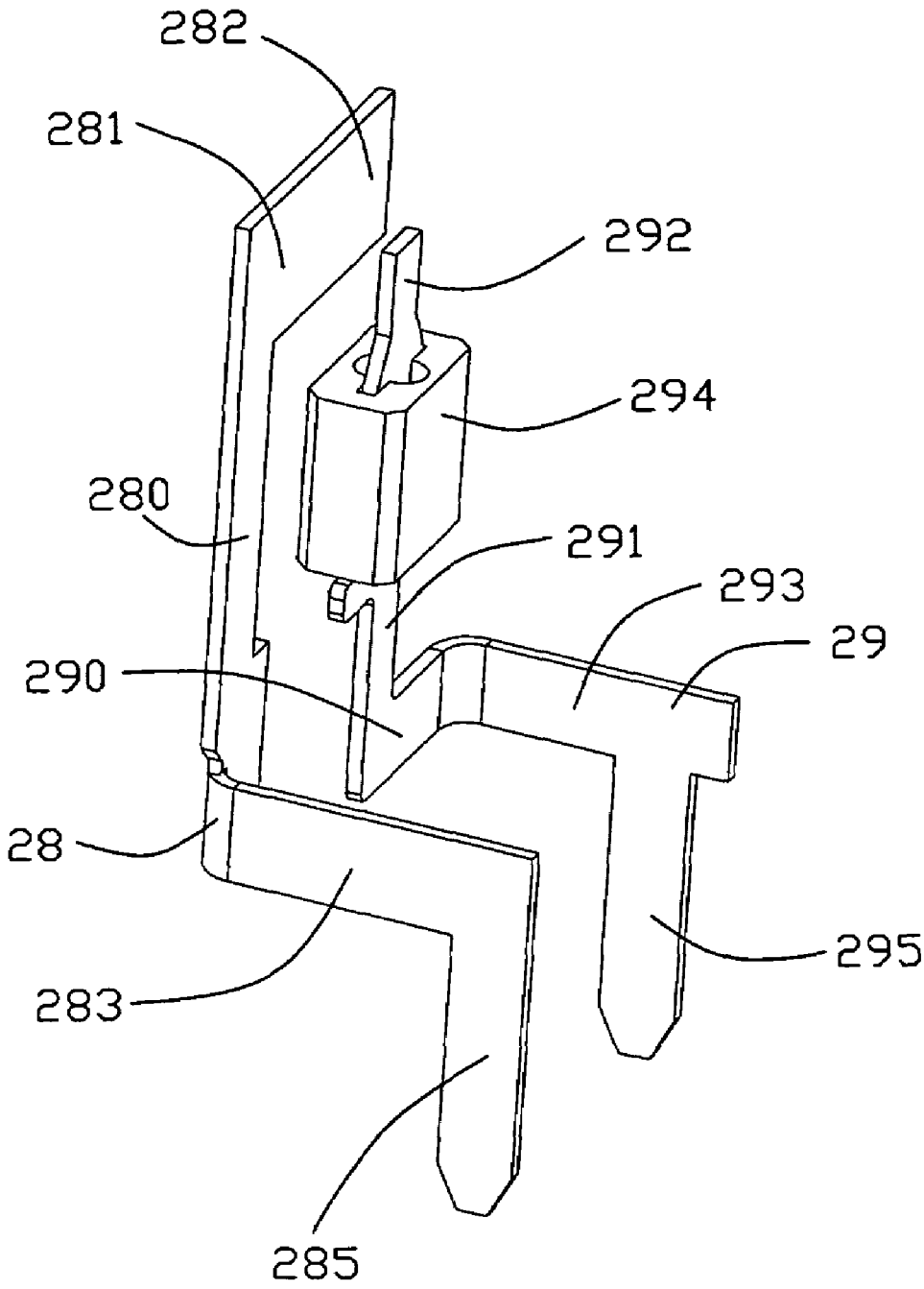
FIG. 7 is a view of the switch in another alternative embodiment of the electrical connector.

As shown in FIG. 7, a third embodiment of the electrical connector 100 is similar to the first embodiment shown in FIGS. 1-5, and differs in that the first contact 28 includes a first connection portion 280 extending vertically and upwardly from the first base portion 283, the first contacting portion 282 extend laterally from the first connection portion 280, the second contact 29 includes a second connection portion 290 extending laterally from the second base portion 293, the second contacting portion 292 extending vertically and upwardly from the second connection portion 290 to be located before the first contacting portion 282.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector to be mounted on a printed circuit board, comprising:
- an insulative housing having a receiving cavity for receiving a mating plug and a plurality of passageways; and
- a plurality of contacts retained in the passageways respectively, including:
  - a first contact which is stationary and having a first contacting portion, a first soldering portion and a first base portion connecting with the first contacting portion and the first soldering portion;
  - a second contact which is movable to mate with the first contact to form a switch and having a second base portion and a second soldering portion extending downwardly from the second base portion, a second contacting portion extending upwardly from the second base portion;
- wherein the first contacting portion extending in a first direction, the second contacting portion extending in a second direction which is not parallel to the first direction.

2. The electrical connector as claimed in claim 1, further comprising a third contact and a fourth contact, the third contact includes a third base portion, a third contacting portion extending into the receiving cavity, a third connection portion projecting downwardly from the third base portion and then forwardly, a third soldering portion extending vertically and downwardly from a front end of the third connection portion; the fourth contact includes a fourth base portion, a fourth contacting portion extending into the receiving cavity, a fourth connection portion projecting downwardly from the fourth base portion and then forwardly, a fourth soldering portion extending vertically and downwardly from a front end of the fourth connection portion.

3. The electrical connector as claimed in claim 2, wherein both the third soldering portion and the fourth soldering portion are shorter than the first soldering portion and the second soldering portion.

4. The electrical connector as claimed in claim 2, wherein the first soldering portion, the second soldering portion and the third soldering portion and the fourth soldering portion are positioned along a line in a lateral direction of the insulative housing.

5. The electrical connector as claimed in claim 1, further comprising a plastic block attached to the second contacting portion to deflect the second contacting portion to move towards the first contacting portion.

6. The electrical connector as claimed in claim 1, wherein the first contacting portion has a semi-circularly curved end to mate with the second contacting portion.

7. The electrical connector as claimed in claim 2, further comprising a fifth contact including a fifth soldering portion which is located before the third soldering portion, the fifth contact defines a fifth base portion, a transition arm projecting upwardly from one end of the fifth base portion and a fifth spring arm extending forwardly from an upper end of the transition arm to be located above the fifth base portion, the fifth spring arm include a fifth contacting portion on a distal end thereof, the fifth contacting portion extends into the receiving cavity to contact with the mating plug.

8. The electrical connector as claimed in claim 7, wherein the fifth spring arm defines a retention arm extending laterally from a substantially middle portion thereof to be fixed in the housing.

9. The electrical connector as claimed in claim 7, further comprising a cover attached to a rear side of the housing, the cover defines a plurality of position tabs, the housing includes a plurality of position holes to lock with the corresponding position tabs.

10. The electrical connector as claimed in claim 9, wherein the cover defines a central slot on an inner side thereof to receive the transition arm of the fifth contact.

11. An electrical connector to be mounted on a printed circuit board, comprising:

an insulative housing having a receiving cavity for receiving a mating plug and a plurality of passageways; and a plurality of contacts retained in the passageways respectively, including:

a first contact which is stationary and having a first contacting portion, a first soldering portion to be fixed on a printed circuit board and a first base portion retained in the insulative housing;

a second contact which is movable to mate with the first contact to form a switch and having a second base portion and a second soldering portion extending downwardly from the second base portion, a second contacting portion defining a contacting area to contact with the first contacting portion;

wherein the first contact and the second contact does not overlap each other except for the contacting area along a direction of the movement of the second contacting portion.

12. The electrical connector as claimed in claim 11, wherein the first contact and the second contact does not overlap each other except for the first soldering portion and the second soldering portion along a direction perpendicular to the direction of the movement of the second contacting portion.

13. The electrical connector as claimed in claim 12, wherein the first contact includes a first connection portion extending vertically and upwardly from the first base portion, the first contacting portion extends laterally from the first connection portion, the second contact includes a second connection portion extending laterally from the second base portion, the second contacting portion extending vertically and upwardly from the second connection portion to be located before the first contacting portion.

14. The electrical connector as claimed in claim 13, wherein the second base portion defines a barb retained in insulative housing along a height direction of the insulative housing and a retaining plate extending downwardly from a side edge of the second base portion to be fixed in insulative housing along a lateral direction of the insulative housing.

15. The electrical connector assembly as claimed in claim 11, wherein the first base portion is U-shaped, the second contacting portion has a semi-circularly curved end to mate with the second contacting portion.

16. An electrical connector assembly comprising:

an insulative housing defining a plug receiving cavity in an axial direction, and defining opposite first and second lateral sides;

a first contacts located on the first lateral side and defining a resilient deflectable contact arm with a first contact section thereon;

a second contact located on the second lateral side and defining a second contact arm with thereon a second contact section which is actuated by the first contact section; wherein the first contact arm extends essentially in the axial direction while the second contact arm extends essentially in a lateral direction perpendicular to said axial direction, and the first contact and the second contact are radially overlapped only at the first contact section and the second contact section which are closer to each other than any other portions of said first contact and said second contact; wherein the first contact is equipped with an insulator which is adapted to be urged by a plug which is inserted into the plug receiving cavity.

* * * * *